US012022929B2

(12) United States Patent
Edmondson et al.

(10) Patent No.: US 12,022,929 B2
(45) Date of Patent: Jul. 2, 2024

(54) CUP MODULE FOR A COSMETIC STICK MECHANISM, CUP COMPRISING SUCH A MODULE, REFILL COMPRISING SUCH A CUP, AND RECEPTACLE COMPRISING SUCH A CUP OR REFILL

(71) Applicant: ALBEA SERVICES, Gennevilliers (FR)

(72) Inventors: Mark Edmondson, Gennevilliers (FR); Frédéric Lecureuil, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 32 days.

(21) Appl. No.: 17/872,532

(22) Filed: Jul. 25, 2022

(65) Prior Publication Data

US 2023/0200516 A1 Jun. 29, 2023

(30) Foreign Application Priority Data

Dec. 24, 2021 (FR) ..... 2114474

(51) Int. Cl.
*A45D 40/06* (2006.01)
*A45D 40/02* (2006.01)
*A45D 40/00* (2006.01)

(52) U.S. Cl.
CPC ..... *A45D 40/02* (2013.01); *A45D 40/06* (2013.01); *A45D 40/065* (2013.01); *A45D 2040/0043* (2013.01); *A45D 2040/0056* (2013.01)

(58) Field of Classification Search
CPC ..... A45D 40/06; A45D 40/065; A45D 2040/0043; A45D 2040/0056
See application file for complete search history.

(56) References Cited

U.S. PATENT DOCUMENTS

| | | | | |
|---|---|---|---|---|
| 9,433,276 | B2 * | 9/2016 | McNamara | A45D 40/06 |
| 9,723,907 | B2 * | 8/2017 | Huang | A45D 40/14 |
| 2014/0270891 | A1 | 9/2014 | Mcnamara et al. | |
| 2016/0309880 | A1 | 10/2016 | Liard | |
| 2017/0065056 | A1 | 3/2017 | Huang et al. | |
| 2021/0393019 | A1 * | 12/2021 | Rome | A45D 40/14 |
| 2022/0087399 | A1 * | 3/2022 | Dunton | A45D 40/16 |

FOREIGN PATENT DOCUMENTS

WO 2014073819 A1 5/2014

OTHER PUBLICATIONS

French Application No. FR 2114474, "Search Report," Jul. 25, 2022, 2 pages.

* cited by examiner

*Primary Examiner* — Jennifer C Chiang
(74) *Attorney, Agent, or Firm* — Kilpatrick Townsend & Stockton LLP

(57) ABSTRACT

A cup for a mechanism of a cosmetic stick includes an irremovable portion and a removable portion. The irremovable portion can be assembled with the mechanism. The removable portion is configured to receive a cosmetic stick and provided with a mounting threads coupled to the irremovable portion. The removable portion is nested inside the irremovable portion and includes a lower neck. The lower neck includes a lower transverse bottom provided with a through opening, and an internal face. The internal face is couplable with an intermediate part configured to be attached at a level of the lower neck of the removable portion.

16 Claims, 14 Drawing Sheets

[Fig. 1]
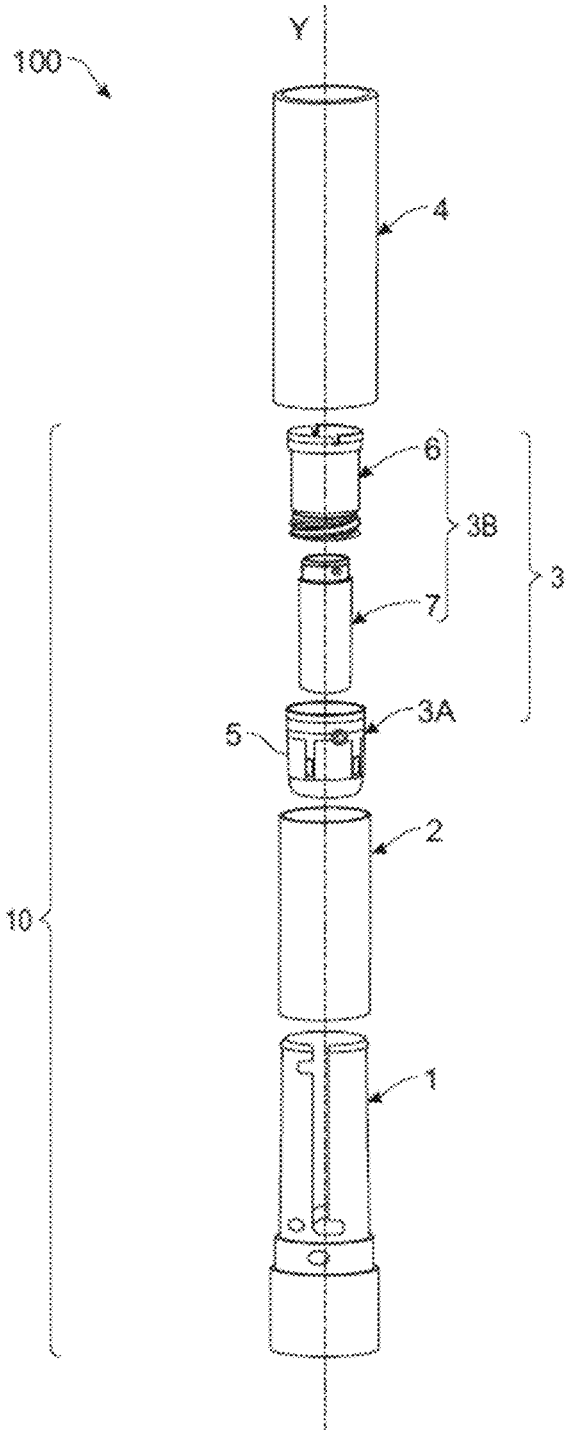

[Fig. 2]
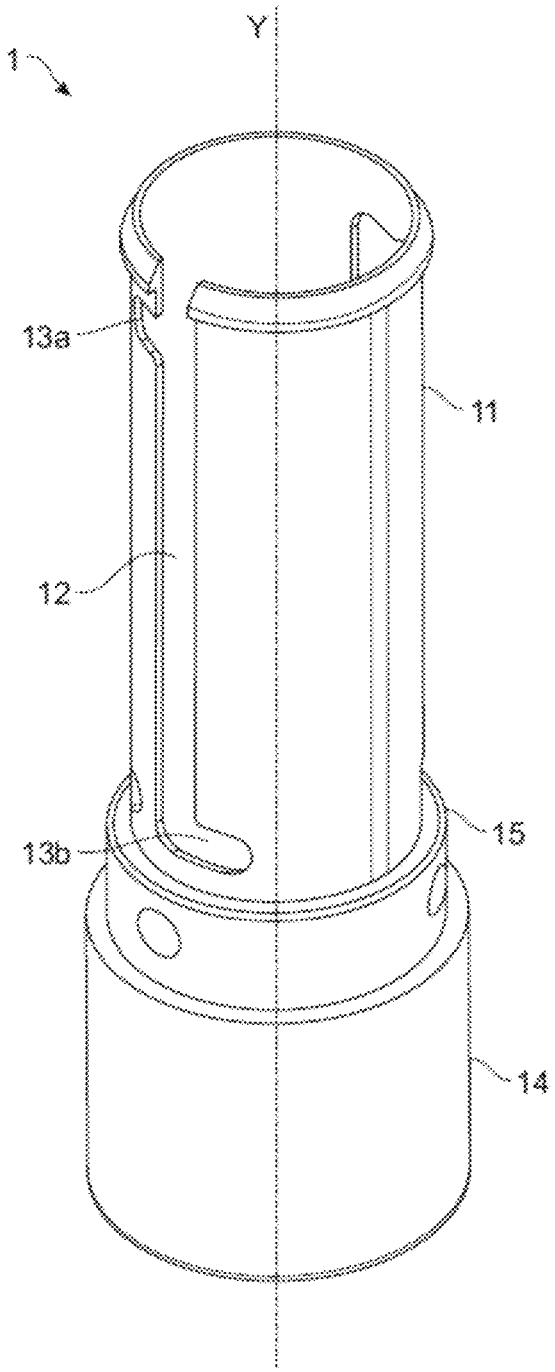

[Fig. 3]
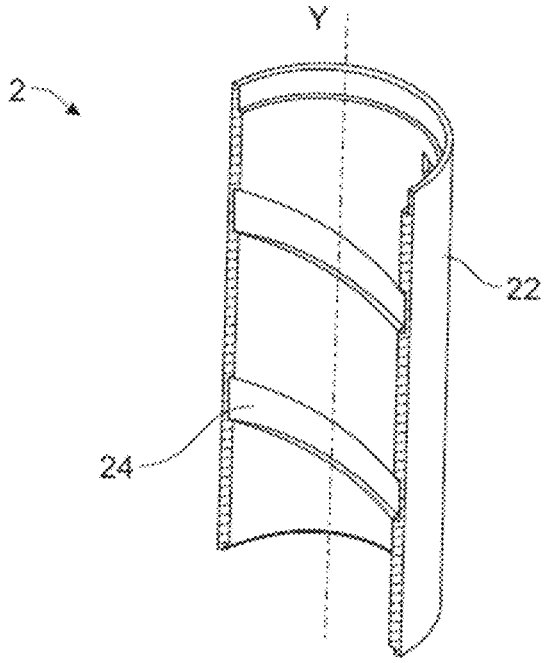

[Fig. 4]
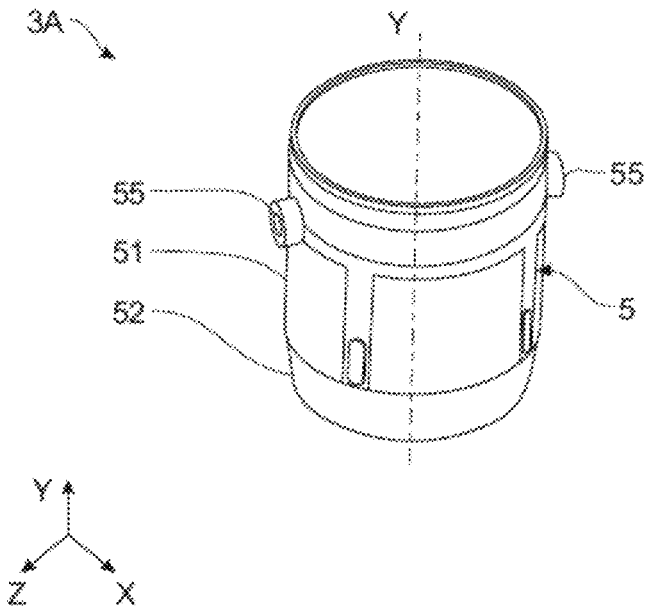

[Fig. 5]
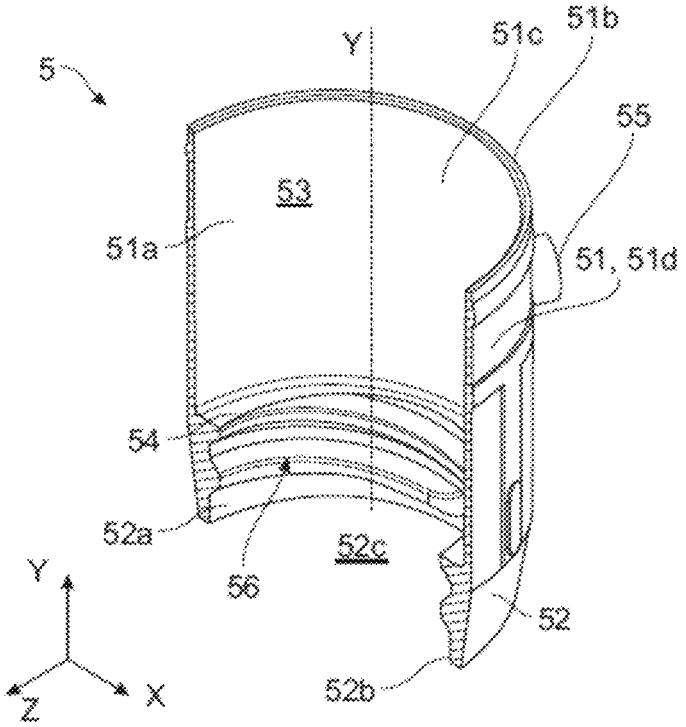

[Fig. 6]
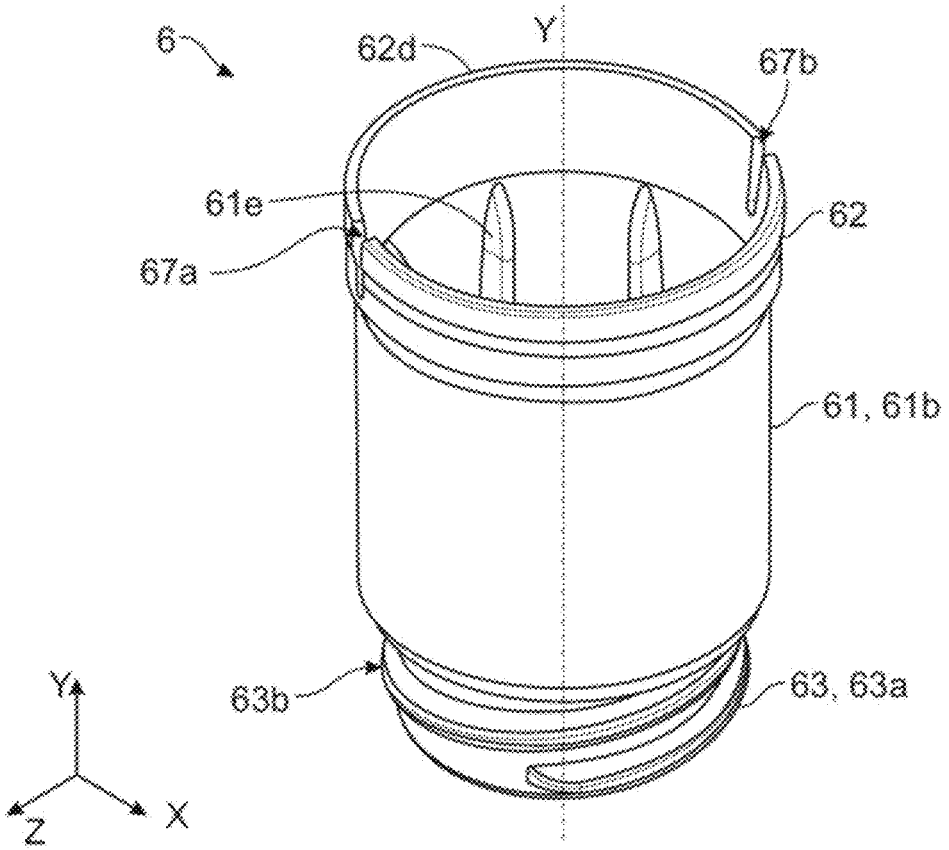

[Fig. 7]
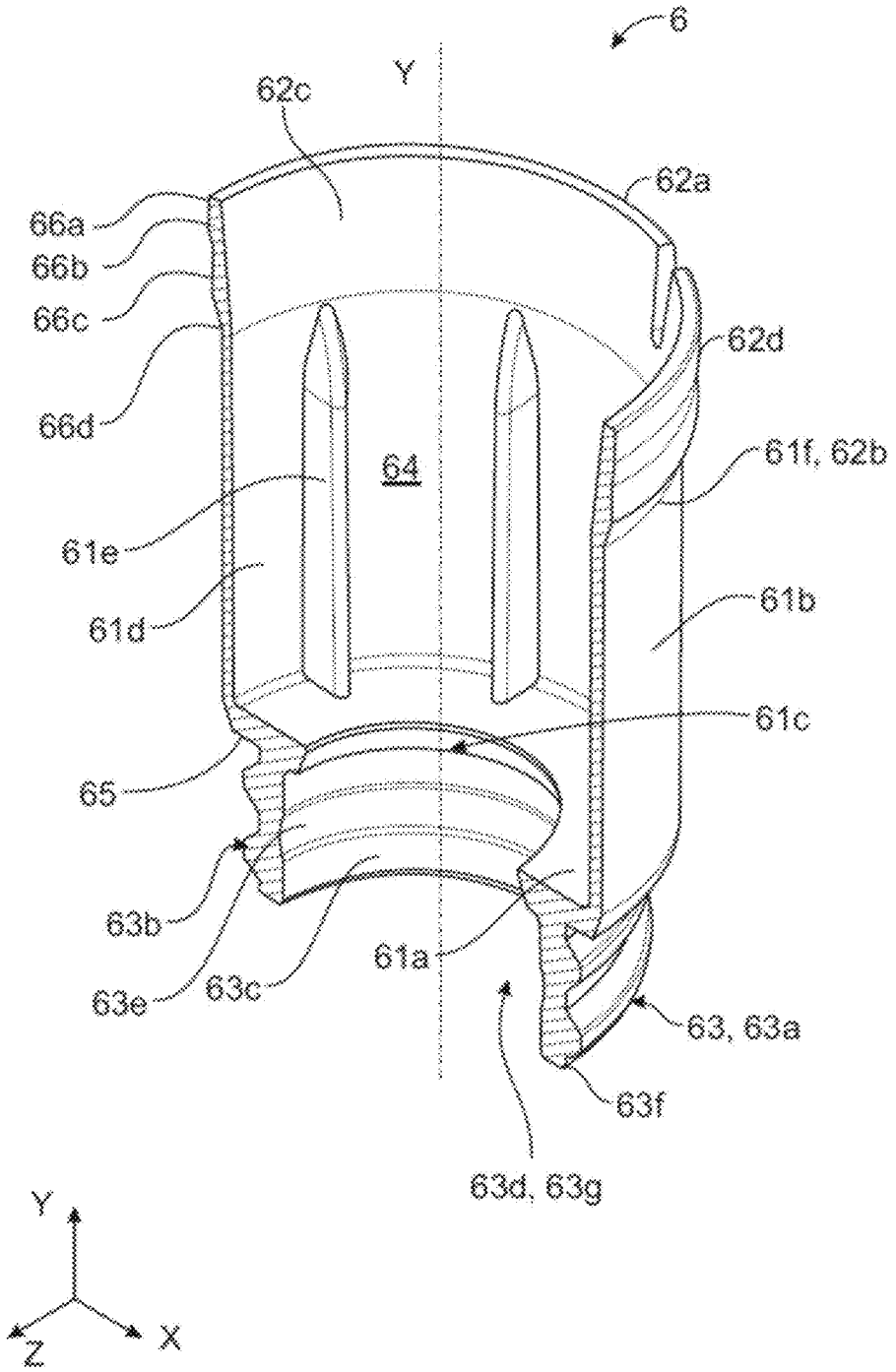

[Fig. 8]
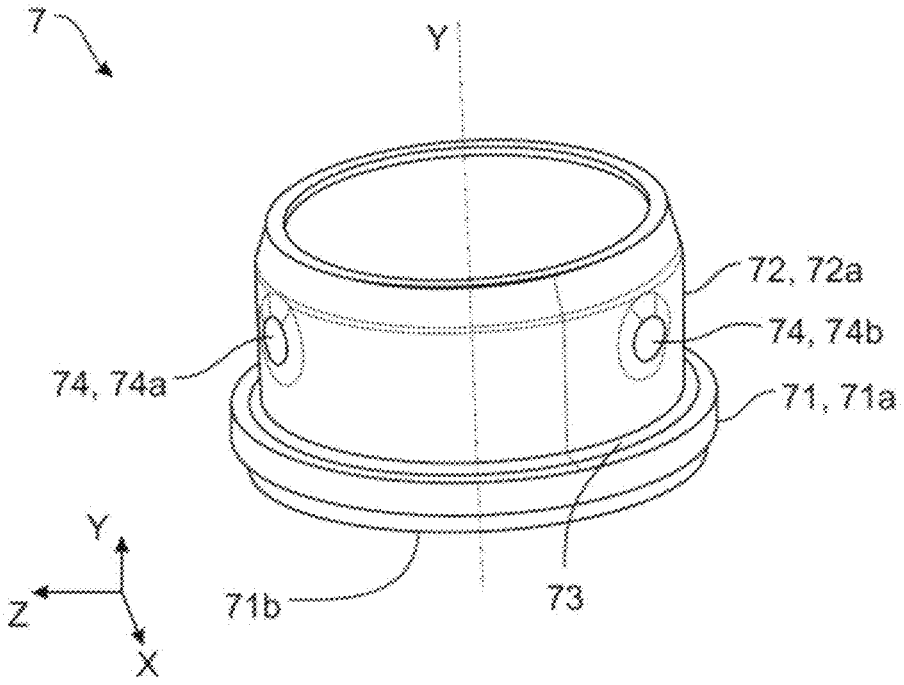

[Fig. 9]
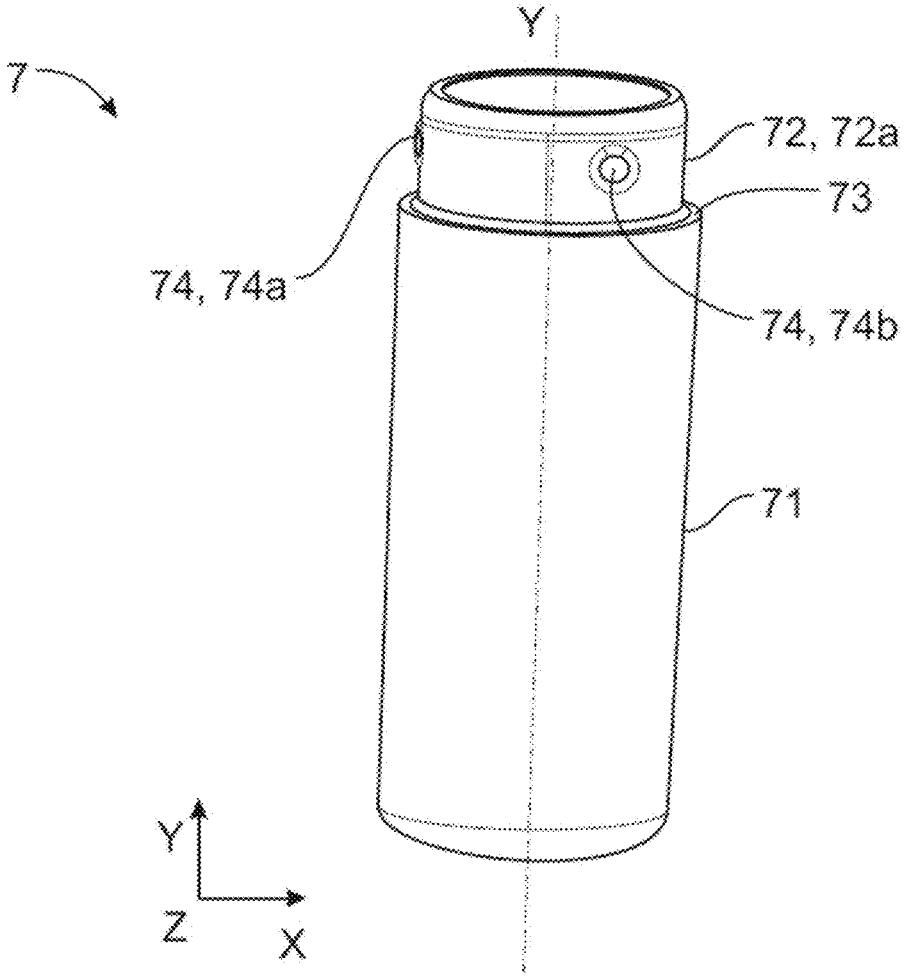

[Fig. 10]
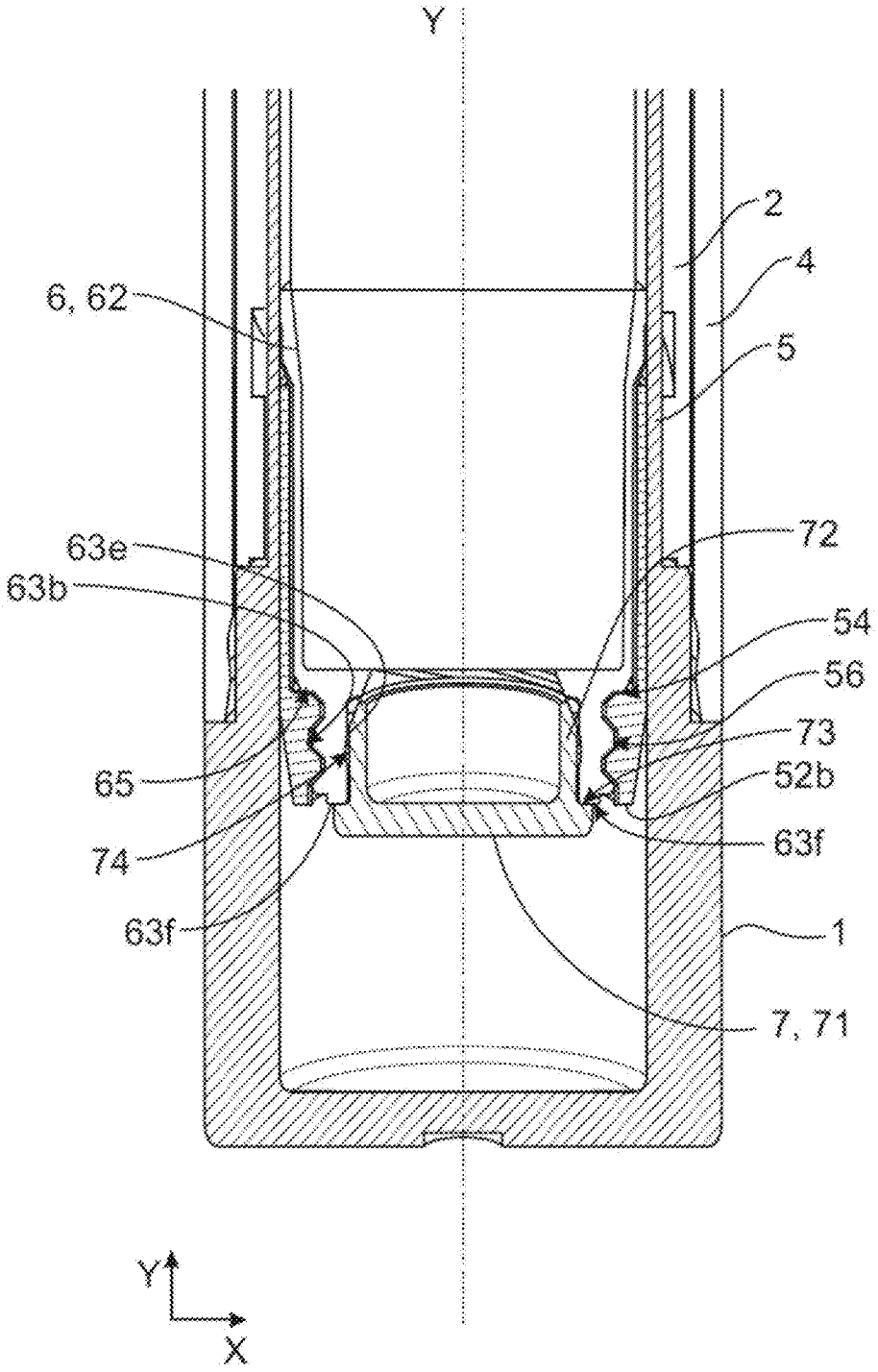

[Fig. 11]
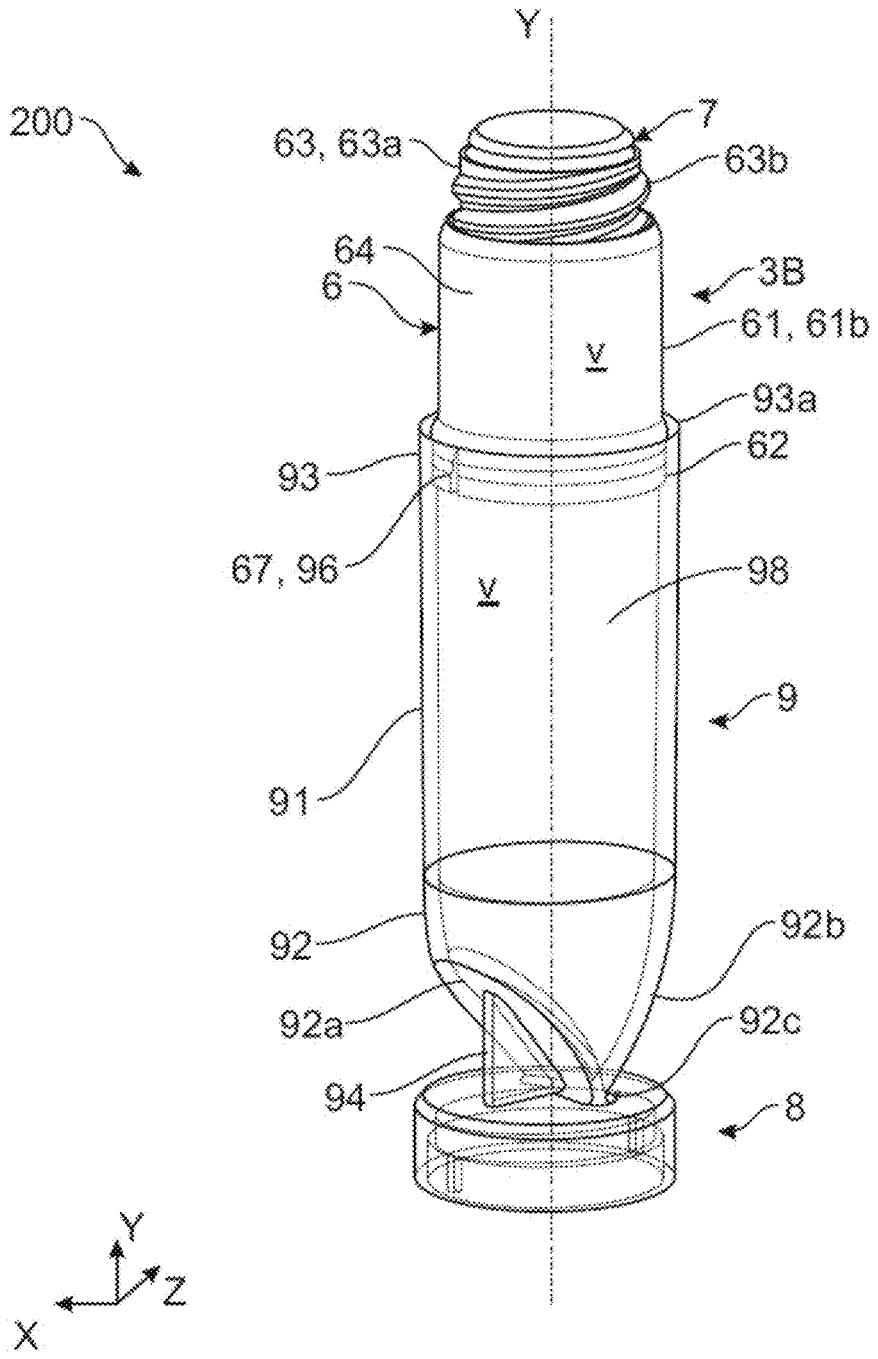

[Fig. 12]
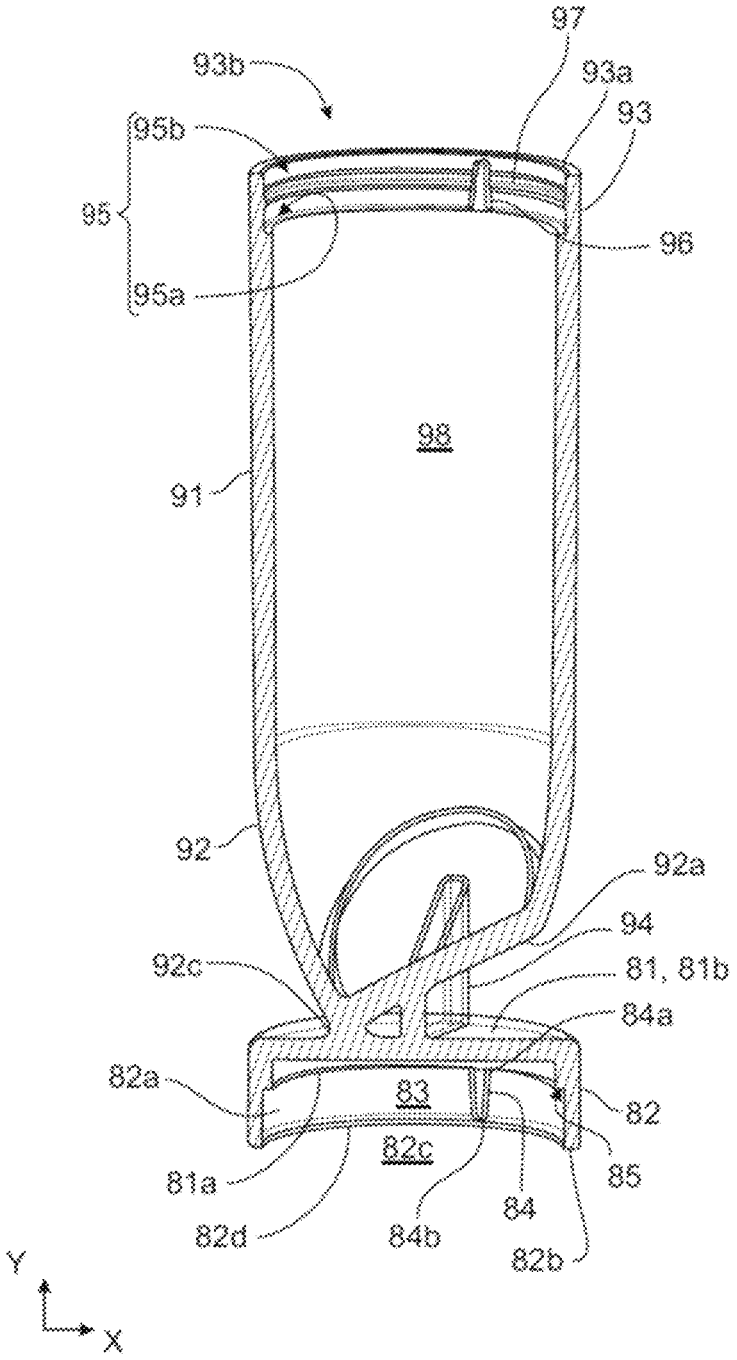

[Fig. 13]
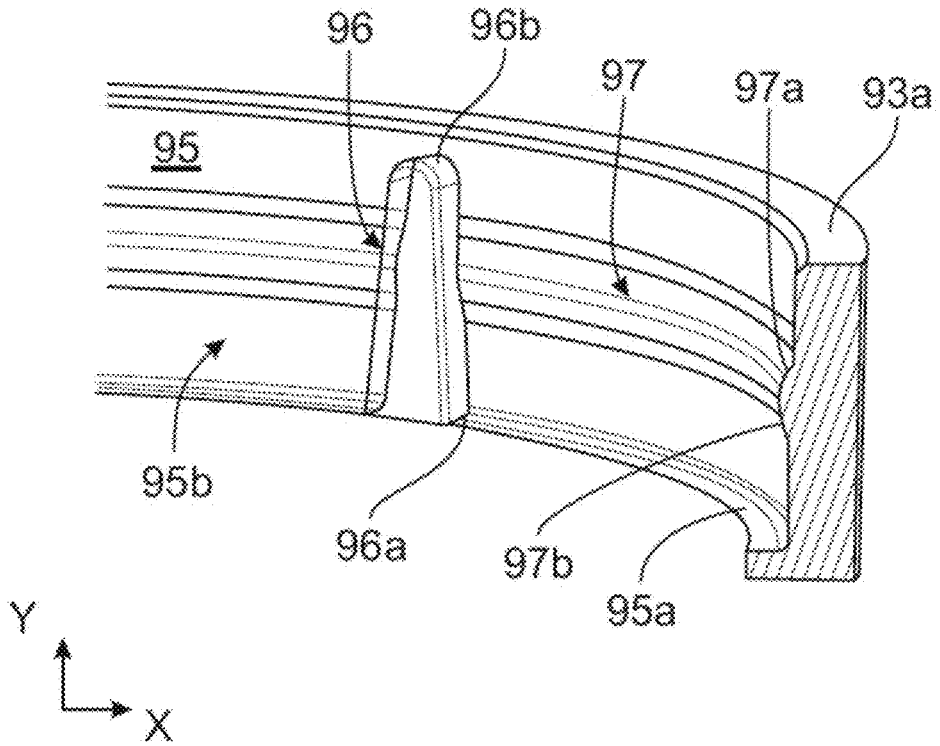
[Fig. 14]
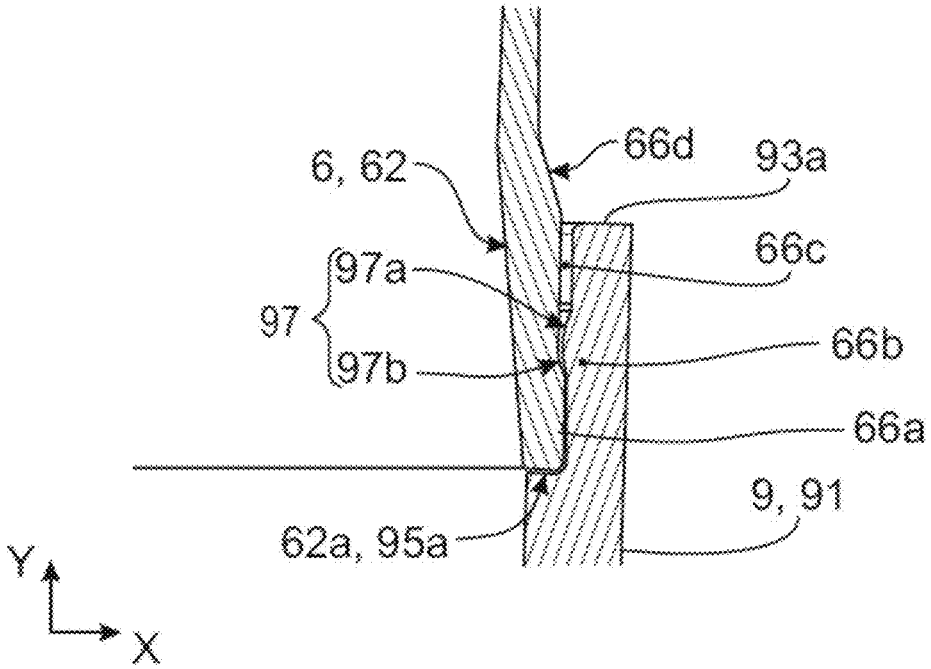

[Fig. 15]
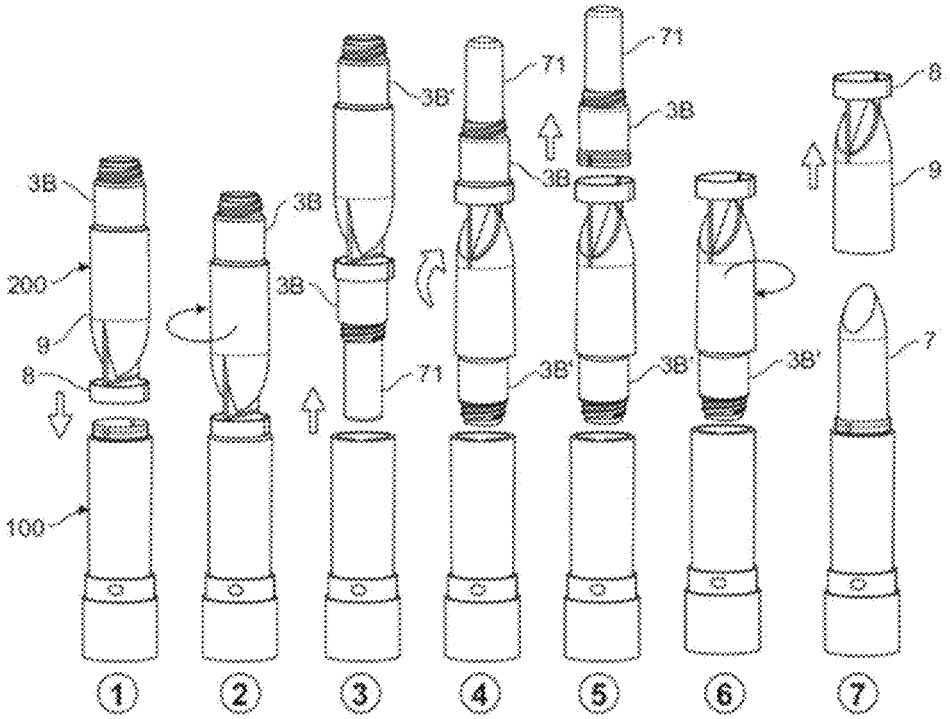

CUP MODULE FOR A COSMETIC STICK MECHANISM, CUP COMPRISING SUCH A MODULE, REFILL COMPRISING SUCH A CUP, AND RECEPTACLE COMPRISING SUCH A CUP OR REFILL

CROSS-REFERENCE TO RELATED APPLICATION

This application is related to and claims priority benefits from French Application No. 2114474, filed Dec. 24, 2021 and titled NOM ET ADRESSE DU DEMANDEUR OU DU MANDATAIRE À QUI LA CORRESPONDANCE DOIT ÊTRE ADRESSÉE, the entire content of which is incorporated herein by this reference.

TECHNICAL FIELD OF THE INVENTION

The invention relates to a cup module for a cosmetic stick mechanism.

According to a second embodiment, the invention relates to a cup comprising such a module.

According to a third embodiment, the invention relates to a refill comprising such a cup.

Finally, according to a fourth and fifth embodiment, the invention relates to a receptacle comprising such a cup or such a refill.

BACKGROUND

A cup for a cosmetic stick mechanism is an element that carries the cosmetic stick and is slidably mounted in a sub-assembly formed by a guide and a sheath of the mechanism. The stick is held by its base in the cup, which slides axially between at least a lower, retracted position and an upper position for using the cosmetic product. In the upper position of the cup, at least one portion of the cosmetic stick extends axially out of the receptacle.

The cup and the entire mechanism can form a refill intended to equip a receptacle for a cosmetic product. The use of such a refill allows to keep some parts of the receptacle, such as a cover and a base of the receptacle. However, the guide, the sheath and the cup must be replaced with the cosmetic stick. This is particularly advantageous if the cover and/or the base are made of precious materials and/or decorated, for example with a lining, which makes parts comparatively more expensive to manufacture.

In other types of receptacles, only the cup is an element to be replaced. The cup is then designed so as to allow the replacement of the cosmetic stick when it is used up.

However, in these receptacles, the gesture to replace the cup in the mechanism remains complex and is not always easy.

On the other hand, when the height of the replacement cosmetic stick is lower than that of the original cosmetic stick, replacing the used cup with a new cup leads to a major difficulty: the user may have to perform several rotations of the mechanism to displace the cosmetic stick carried by the new cup from the lower position towards the upper position of use.

Generally speaking, depending on the dimensions of the cosmetic stick carried by the cup, in particular its height, the user may have to perform several rotations of the mechanism to displace the cosmetic stick carried by the cup from the lower position towards the upper position of use.

Thus, there is a need for a solution that allows to address at least some of the disadvantages of the prior art.

SUMMARY OF THE INVENTION

According to a first embodiment, the invention proposes a cup module for a cosmetic stick mechanism, the module being configured to receive a cosmetic stick, to form a removable portion of the cup, and to be nested inside an irremovable portion of the cup, the module comprising at least one mounting means adapted to be coupled to the irremovable portion of the cup, and a lower neck having:

a lower transverse bottom provided with a through opening, and an internal face provided with a first attachment means intended to cooperate with a second attachment means of an intermediate part configured to be attached at the level of the lower neck of the module.

The term "removable portion" means an element that is mounted in the mechanism and can be removed from the mechanism without destroying or deforming the parts of the assembly.

The term "irremovable portion" means an element that is permanently mounted in the mechanism, i.e. without the possibility of being separated from the mechanism, and which nevertheless retains the possibility of displacing in relation to and within the mechanism.

By introducing a through opening at the level of the lower transverse bottom of the cup module, the invention opens the possibility of forming the cosmetic stick directly in this module, in particular after casting cosmetic product through this lower opening. Thanks to this in situ casting, the invention allows to dispense with the step of transferring a cosmetic stick that would be previously pre-formed outside the cup module.

Furthermore, the invention introduces the possibility of mounting an intermediate part in this through opening so as to provide additional functions to the cup module. For example, the intermediate part can be a sealing plug that closes the through opening, or an elevator whose height can be set according to the size of the cosmetic stick.

In the case of an intermediate part formed by an elevator, it becomes possible, without modifying the mechanism, to adjust the stroke of the cup through the mechanism by acting on the height of the elevator.

According to a second embodiment, the invention concerns a cup for a mechanism of a cosmetic stick, comprising a first portion, referred to as the irremovable portion, provided with at least one means of assembly with the mechanism, and a second portion, referred to as removable portion, configured to receive a cosmetic stick and provided with at least one mounting means coupled to the irremovable portion, the removable portion being nested inside the irremovable portion and comprising a lower neck having:

a lower transverse bottom provided with a through opening, and an internal face provided with a first attachment means intended to cooperate with a second attachment means of an intermediate part configured to be attached at the level of the lower neck of the removable portion.

The term "removable" means that the second portion of the cup is mounted in the mechanism and can be removed from the mechanism without destroying or deforming the parts of the assembly.

The term "irremovable" means that the first portion of the cup is permanently mounted in the mechanism, i.e. it cannot be removed from the mechanism while remaining movable within the mechanism.

Thus, by introducing a through opening at the level of the transversal lower bottom of the removable portion of the cup, the invention opens the possibility of forming the cosmetic stick directly in the removable portion, in particular after casting cosmetic product through this lower opening. Thanks to this in situ casting, the invention allows to dispense with the step of transferring a cosmetic stick that would be preformed outside the cup.

Furthermore, the invention introduces the possibility of mounting an intermediate part in this through opening so as to provide additional functions to the cup. For example, the intermediate part can be a sealing plug that closes the through opening, or an elevator whose height can be set according to the size of the cosmetic stick.

In the second case, without modifying the mechanism, it becomes possible to adjust the stroke of the cup through the mechanism by acting on the height of the elevator.

The invention according to this second embodiment may also comprise any of the following characteristics, taken individually or in any technically feasible combination:

the assembling means of the irremovable portion comprise at least one lug;

the first attachment means is a circular notch formed on the internal face of the removable portion;

the second attachment means comprises at least one protrusion formed on an external face of a skirt of the intermediate part;

the irremovable portion comprises at least one mounting means cooperating with the at least one means for mounting the removable portion;

the at least one means for mounting the irremovable portion comprises an internal thread formed on an internal face of the irremovable portion;

the at least one means for mounting the removable portion comprises a thread formed on an external face of the removable portion.

According to a third embodiment, the invention relates to a refill for a mechanism of a cosmetic stick, comprising a cosmetic stick and a support carrying the cosmetic stick, the support being configured to form a removable portion of a cup of the mechanism, the support comprising a lower neck having:

a lower transverse bottom provided with a through opening, and an internal face provided with a first attachment means intended to cooperate with a second attachment means of an intermediate part configured to be attached at the level of the lower neck of the support.

The support as introduced by the invention may constitute a single part of the refill, associated with the cosmetic stick. Thus, with a refill comprising a single part to carry the cosmetic stick, the invention facilitates not only the manufacture, but also the recyclability of the refill.

Furthermore, once the cosmetic stick is finished, the user has only the support as the unique part to dispose. The other elements of the mechanism, in particular complex parts, can be kept and reused later with a new refill.

Thus, the invention contributes to the reduction of waste.

It should be noted that by introducing a through opening at the level of the lower transverse bottom of the support, the invention opens up the possibility of forming the cosmetic stick directly in the support, in particular after casting cosmetic product through this lower opening. Thanks to this in situ casting, the invention allows to dispense with the step of transferring a cosmetic stick that would be preformed outside the support.

In addition, the invention introduces the possibility of mounting an intermediate part in this through opening in order to provide additional functions to the support. For example, the intermediate part can be a sealing plug that closes the through opening, or an elevator whose height can be set according to the size of the cosmetic stick.

In the case of an intermediate part formed by an elevator, it becomes possible, without modifying the mechanism, to adjust the stroke of the cup through the mechanism by acting on the height of the elevator. In other words, with a same mechanism, it is possible to use different types of refills without having to take into account the dimensions, in particular its height.

The invention according to this third embodiment may also comprise any of the following characteristics, taken individually or in any technically feasible combination:

the support comprises at least one mounting means configured to reversibly cooperate with at least one means for mounting an irremovable portion of the cup of the mechanism;

the intermediate part is a plug for closing the through opening, the refill also comprises a protective casing;

the protective casing of the refill forms a housing intended to be in communication with a housing of the support of the refill;

the housing of the protective casing and the housing of the support form a volume of the cosmetic stick;

the protective casing comprises a truncated ogive-shaped head;

the head of the protective casing has a flat inclined face forming an acute angle with a main axis of the refill;

the refill further comprises a tool configured to allow a dismounting of the support mounted in a mechanism of a cosmetic stick;

the tool comprises at least one proximal coupling means;

the at least one proximal coupling means of the tool is configured to cooperate with at least one hooking means of the support mounted in the mechanism;

the at least one proximal coupling means of the tool comprises at least one vertical rib;

the at least one vertical rib is formed on an internal wall of the tool;

the at least one hooking means of the support of the refill comprises at least one vertical slit;

the at least one vertical slit of the support of the refill extends from a free edge of the support of the refill;

the protective casing has a distal segment provided with at least one distal coupling means;

the at least one distal coupling means of the protective casing cooperates with the at least one hooking means of the support of the refill so that the support of the refill is attached to the protective casing;

the at least one distal coupling means of the protective casing comprises at least one vertical rib;

the at least one vertical rib of the protective casing is formed on an internal wall of the distal segment of the protective casing;

the distal segment of the protective casing is provided with at least one second distal coupling means;

the at least second distal coupling means of the protective casing cooperates with at least one second hooking means of the support of the refill;

the at least one second distal coupling means of the protective casing is a circular rib;

the circular rib is formed on the internal wall of the distal segment of the protective casing;

the at least second hooking means of the support of the refill is a flared lip;

the tool is located at a proximal end of the protective casing;

the tool is located opposite the support of the refill, the intermediate part is an elevator intended to hold the support in an upper position with respect to a bottom of the mechanism, the intermediate part is a sealing plug.

According to a fourth embodiment, the invention relates to a receptacle for a cosmetic product comprising a cup as defined above.

According to a fifth embodiment, the invention relates to a receptacle for a cosmetic product comprising a refill as defined above.

BRIEF DESCRIPTION OF THE FIGURES

The invention will be better understood and further details, characteristics and advantages of the invention will become apparent from the following description made by way of non-limiting example and with reference to the attached drawings in which:

FIG. 1 is an exploded isometric view of a receptacle according to the invention;

FIG. 2 is an isometric view of a guide of a mechanism of the receptacle of FIG. 1;

FIG. 3 is an isometric cross-sectional view of a sheath of the mechanism of the receptacle of FIG. 1;

FIG. 4 is an isometric view of an irremovable portion of a cup according to the invention of the mechanism of the receptacle of FIG. 1;

FIG. 5 is an isometric cross-sectional view of the irremovable portion of FIG. 4;

FIG. 6 is an isometric view of a removable portion of a cup according to the invention of the mechanism of the receptacle of FIG. 1;

FIG. 7 is an isometric cross-sectional view of the removable portion of FIG. 6;

FIG. 8 is an isometric view of a first example of a plug of the removable portion of FIG. 6;

FIG. 9 is an isometric view of a second example of a plug of the removable portion of FIG. 6;

FIG. 10 is a cross-sectional view showing the interior of a receptacle according to the invention in an assembly configuration of a cup according to the invention;

FIG. 11 is an isometric view of a refill according to the invention;

FIG. 12 is an isometric cross-sectional view of the refill of FIG. 11 without the removable portion of the cup;

FIG. 13 is a cross-sectional view showing a detail of FIG. 12;

FIG. 14 is a cross-sectional view showing another detail of FIG. 12;

FIG. 15 illustrates different steps for using the refill in FIG. 12.

DETAILED DESCRIPTION OF THE INVENTION

By convention, the central axis Y is an axis passing through the middle of the receptacle perpendicular to a plane containing a lower edge or an upper edge of the receptacle. The central axis Y is located substantially equidistant from two diametrically opposed points on the lower edge or upper edge of the receptacle. A direction orthogonal to the central axis Y is referred to as radial direction.

In the following detailed description of the figures, the terms "upper" and "lower" or "top" and "bottom" will be used in reference to the central axis Y.

Similarly, unless otherwise noted, the terms "outer or external" and "inner or internal" are used in reference to the radial direction, with an outer element being radially farther from the central axis Y than an inner element.

In the remainder of the description, unless otherwise indicated, elements having an identical structure or similar functions will be designated by the same references.

As illustrated in FIG. 1, the present invention relates to a receptacle 100 for a cosmetic product, and more specifically a stick or bullet shaped cosmetic product. It can be for example a lipstick.

The receptacle 100 comprises a guide 1, a sheath 2 and a cup 3 which form a mechanism 10 of the receptacle 100. The receptacle 100 also comprises a cover 4 which is intended to cap the mechanism 10. In particular, the sheath 2 is intended to be threaded around the guide 1. The cup 3 is intended to carry the cosmetic stick. Furthermore, the cup 3 is intended to be mounted in the guide 1 between a retracted or low position and a protruding position or top position of use.

In a known manner, with reference to FIG. 2, the guide 1 comprises a tube 11 which is provided with at least one slit or slide 12 extending along the central axis Y. The at least one slit 12 has an upper end and a lower end, each of which extends into a circumferential notch or indentation 13*a*, 13*b*. Here the guide 1 comprises two diametrically opposed slits 12. The guide 1 also comprises a base 14 that carries the tube 11. The base 14 projects radially from the tube 11. The base 14 and the tube 11 thus form a shoulder 15.

Also in a known manner, with reference to FIG. 3, the sheath 2 is in the form of a tube 22. In addition, the sheath 2 comprises at least one helical groove 24. Here, the sheath 2 comprises two helical grooves.

Again with reference to FIG. 1, the cup 3 comprises a first portion 3A, referred to as the irremovable portion, which cooperates with the mechanism 10, and a second portion 3B, referred to as the removable portion, which is intended to carry the cosmetic stick. The removable portion 3B is intended to be nested into the irremovable portion 3A. The second portion 3B is also referred to as cup module 3B.

The term "irremovable" means that the first portion 3A of the cup 3 is permanently mounted in the mechanism 10 of the receptacle 100. The first portion 3A is thus mounted without the possibility of being dismounted from the receptacle 100, except by deforming or destroying at least one of the parts of the assembly.

The term "removable" means that the second portion 3B of the cup 3 is mounted in the mechanism 10 of the receptacle 100 in such a way that it can be removed without destroying or deforming the parts of the assembly. Thus, the removable portion 3B can be replaced by another removable portion carrying another cosmetic stick, which confers on the receptacle 100 a refillable character.

With reference to FIGS. 4 and 5, the irremovable portion 3A of the cup 3 is formed by a sleeve 5 which comprises an upper segment 51, as well as a lower segment 52. The upper segment 51 and the lower segment 52 form a housing 53. In addition, the upper segment 51 and the lower segment 52 form an internal shoulder 54. More specifically, the internal shoulder 54 of the sleeve 5 is formed between an internal face 51*a* of the upper segment 51 and an internal face 52*a* of the lower segment 52 of the sleeve 5.

The upper segment 51 of the sleeve 5 defines an upper edge 51*b* and an upper opening 51*c* of the sleeve 5. In addition, the upper segment 51 of the sleeve 5 has an external face 51*d* that carries a means for assembling the cup 3 with the rest of the mechanism 10.

Furthermore, the lower segment 52 of the sleeve 5 defines a lower edge 52*b* and a lower opening 52*c* of the sleeve 5. In addition, the lower segment 52 of the sleeve 5 has at the level of its internal face 52*a* a first mounting means 56 intended to cooperate with the removable portion 3B of the cup 3.

According to the illustrated embodiment, the upper segment 51 of the sleeve 5 has a cylindrical shape. The lower segment 52 has a frustoconical shape. The upper segment 51 has a greater height than that of the lower segment 53. Furthermore, the means 55 for assembling the sleeve 5 with the rest of the mechanism 10 comprises at least one lug 55, here two lugs 55, formed on the upper segment 51 of the sleeve 5. The at least one lug 55 of the sleeve 5 is intended to engage in the at least one slit 14 of the guide 1 and then in the helical groove 24 of the sheath 2. Finally, the first mounting means 56 of the sleeve 5 is formed by an internal thread.

With reference to FIGS. 6 and 7, the removable portion 3B of the cup 3 comprises a barrel 6 that has a central segment 61, a cap 62, and a neck 63. The cap 62 extends over the central segment 61. The neck 63 extends below the central segment 61. The central segment 61 and the cap 62 form a housing 64 intended to receive the cosmetic stick. In other words, the cap 62 and the central segment 61 of the barrel 6 are intended to be in contact with the cosmetic stick. The central segment 61 and the neck 63 of the barrel 6 form an external shoulder 65, with the central segment 61 projecting radially from the neck 63.

In particular, the central segment 61 of the barrel 6, here cylindrical in shape, comprises a bottom 61*a* as well as a peripheral wall 61*b* that extends perpendicularly from the bottom 61*a*. The bottom 61*a* of the barrel 6 forms a seat for the cosmetic stick in the barrel 6. In addition, the bottom 61*a* of the barrel 6 comprises an opening 61*c*. Here, the opening 61*c* is formed in the centre of the bottom 61*a*. Furthermore, the peripheral wall 61*b* of the barrel 6 has an internal face 61*d* which is provided with ribs 61*e* intended to promote the hooking of the cosmetic product in the barrel 6. Here, the ribs 61*e* are evenly distributed on the internal face 61*d* of the peripheral wall 61*b* of the barrel 6. In addition, the peripheral wall 61*b* of the barrel 6 is delimited by an upper edge 61*f* opposite the bottom 61*a*.

The cap 62 of the barrel 6 extends from the upper edge 61*f* of the central segment 61. The cap 62 of the barrel 6 has an upper edge 62*a* and a lower edge 62*b*. The lower edge 62*b* of the cap 6 merges with the lower edge 61*f* of the central segment 61 of the barrel 6. The upper edge 62*a* of the cap defines a free edge of the barrel 6. In addition, the cap 62 comprises a regular internal face 62*c* and an irregular external face 62*d*. By "regular" is meant that the internal face 62*c* of the cap 62 has a shape without any relief. By "irregular" is meant that the external face 62*d* of the cap 62 has a profile with a relief, and more specifically a stepped profile. Finally, the cap 62 of the barrel 6 has at least one hooking means 67 configured to cooperate with a third element in order to facilitate a dismounting of the removable portion 3B with respect to the irremovable portion 3A of the cup 3.

The lower neck 63 of the barrel 6 has an external face 63*a* that forms with the external face 61*b* of the central segment 61 the external shoulder 65 of the barrel 6. The external face 63*a* of the neck 63 is provided with a second mounting means 63*b* intended to cooperate with the first mounting means 56 of the sleeve 5. In addition, the lower neck 63 of the barrel 6 has an internal face 63*c* which forms a channel 63*d*, said internal face 63*c* being provided with a first attachment means 63*e* intended to cooperate with an intermediate part. Here, the intermediate part is a plug 7. Finally, the lower neck 63 of the barrel 6 has a lower transverse bottom 63*f* which is provided with a lower opening 63*g*.

It should be noted that the lower opening 63*g* of the lower neck 63 communicates with the channel 63*d* of said neck 63. The channel 63*d* of the lower neck 63 is itself in communication with the housing 64 formed by the central segment 61 and the cap 62 of the barrel 6. The channel 63*d* of the lower neck 63 communicates with the housing 64 through the through opening 61*c* of the bottom 61*a*. Thus, the lower opening 63*g* of the lower neck 63 allows a molten material to be casted into the housing 64 of the barrel 6, which, after solidification, forms the cosmetic stick. The plug 7 allows to protect the cosmetic stick thus obtained.

In the embodiment illustrated in particular in FIGS. 6 and 7, the cap 62 has a flared shape between its upper edge 62*a* and its lower edge 62*b*. The hooking means 67 of the cap 62 comprises at least one slit 67*a*, 67*b* that extends from the upper free edge 62*d* of the cap 62 to a distance from the lower edge 62*b* of the cap 62. In other words, a lower segment of the cap 62 is not slit. Here, the hooking means comprises two slits 67*a*, 67*b* that are diametrically opposed. The slits 67*a*, 67*b* thus divide the cap 62 into two opposing lips. The slits 67*a*, 67*b* confer on the cap 62 a certain flexibility allowing the barrel 6 to nest elastically into a refill, for example, as described below.

It should be noted that each lip of the cap 62 has a stepped profile at the level of the external face 62*d* of the cap 62. This profile comprises, starting from the free upper edge 62*a* towards the lower edge 62*b* of the cap 62, a first straight segment 66*a*, a first ramp 66*b*, and a second straight segment 66*c*. The first straight segment 66*a* projects radially from the second straight segment 66*c*.

It should also be noted that the lower un-slit segment 66*d* of the cap 62 is in the form of a ramp that is set back from the first ramps 66*b* of the cap 62.

In the embodiment illustrated in particular in FIGS. 5 to 7, the second mounting means 63*b* of the neck 63 comprises an external thread 63*b* intended to cooperate with the internal thread 56 of the sleeve 5. In addition, the first attachment means 63*e* of the neck 63 comprises a notch 63*e* that extends at least partly over a circumference of the internal face 63*c* of the neck. Here the notch 63*e* makes a complete turn of the internal face 63*c* of the neck 63.

With reference to FIG. 8, the plug 7 comprises a bottom 71 as well as a skirt 72 that extends perpendicularly from the bottom 71. The bottom 71 and the skirt 72 of the plug 7 form an external shoulder 73. More specifically, the shoulder 73 of the plug 7 is formed by an external face 72*a* of the skirt 72 and a lateral face 71*a* of the bottom 71.

The skirt 72 of the plug 7 is intended to be mounted in the channel 63*d* of the lower neck 63 of the barrel 6. In particular, the skirt 72 of the plug 7 is intended to be attached opposite the internal face 63*c* of the lower neck 63 of the barrel 6. To do this, the skirt 72 of the plug 7 has at the level of its external face 72*a* at least one second attachment means 74 intended to cooperate with the first attachment means 63*e* of the neck 63. When the skirt 72 of the plug 7 is engaged in the channel 63*d* of the lower neck 63 of the barrel 6, the external shoulder 73 of the plug 7 abuts against the lower transverse bottom 63*f* of the neck 63.

In the examples of embodiments of plugs shown in FIGS. 8 and 9, the second attachment means 74 of the plug 7 comprises at least one protrusion which is intended to cooperate with the notch 63*e* formed on the internal face 63*d* of the neck 63 of the barrel 6. Here, the second attachment means comprises three evenly distributed protrusions, two of which 74*a*, 74*b* are visible in FIG. 8.

Referring to FIG. 9 illustrating a second example of a plug, the bottom 71 of the plug 7 has a height greater than the height of the bottom 71 of the plug 7 of the first example. This arrangement allows the cup 3 to be held in the upper position in the receptacle 10. According to this variant, the bottom 71 of the plug 7 thus forms an elevator for the cup 3, allowing a small cosmetic stick to be mounted in the receptacle 100, without the need to modify the stroke or the height of the slits 12 of the mechanism 10.

In an alternative embodiment not shown, the plug 7 may be provided with an extension fitted at the level of the bottom 71 of the plug. This extension then forms the elevator of the cup 3. The elevator thus formed comprises an upper end adjacent to a lower face 71*b* of the bottom 71 of the plug 7, as well as an opposite lower end intended to rest on a bottom of the receptacle 100.

To produce the mechanism 10, a first step consists in obtaining separately, on the one hand, the sleeve 5 forming the irremovable portion of the cup; and on the other hand, the barrel 6 and the plug 7 forming the removable portion 3B of the cup 3. The sleeve 5, the barrel 6 and the plug 7 are obtained, for example, by injection moulding of a plastic material. Then a molten material is casted into the barrel 6. This molten material will form, after solidification, the cosmetic stick.

After this step of casting the molten material into the barrel 6, the opening 63*g* of the lower neck 63 of the barrel 6 is closed by the plug 7. Thus, the skirt 72 of the plug 7 is inserted into the channel 63*d* of the neck 63. The at least one protrusion 74 of the skirt 72 cooperates with the notch 63*e* of the barrel 6. The shoulder 73 of the plug 7 abuts against the lower transverse bottom 63*f* of the neck 63. A sub-assembly is thus obtained comprising the removable portion 3B of the cup 3 as well as the cosmetic stick carried by this removable portion 3B of the cup 3.

Finally, a last step of manufacturing the mechanism 10 consists in mounting the sub-assembly formed by the cosmetic stick and the removable portion 3B of the cup 3 in the sleeve 5 forming the irremovable portion 3B of the cup 3. To realize this step, the sleeve 5 is advantageously installed in the guide 1 beforehand. At the end of this step, as shown in FIG. 10, the first mounting means 56 of the sleeve 5 cooperates with the second mounting means 63*b* of the neck 63. The barrel 6, and in particular the cap 62 of the barrel 6, opens out of the upper opening 51*c* of the sleeve 5. The external shoulder 65 of the barrel 6 abuts against the internal shoulder 54 of the sleeve 5. The lower edge 52*b* of the sleeve 5 is aligned with the lower transverse bottom 63*f* of the neck 63. The plug 7 opens from the lower opening 52*c* of the sleeve 5.

When the removable portion 3B of the cup 3 is emptied of its cosmetic stick or for any other reason, the user can remove this removable portion 3B from the receptacle 100 to replace it with another removable portion carrying a spare cosmetic stick.

Thus, according to a second embodiment illustrated in FIG. 11, the invention relates to a refill 200 that comprises a support 3B carrying a spare cosmetic stick P. The support 3B is configured to form the removable portion 3B of the cup 3 described above. The support 3B thus has the characteristics of the removable portion 3B of the cup 3 described above. In other words, the support 3B is configured to cooperate with the irremovable portion 3A of the cup 3 described above.

The refill 200 further comprises a tool 8 as well as a protective casing 9 that carries both the tool 8 and the sub-assembly formed by the support 3B and the cosmetic stick P. The tool 8 is configured to facilitate the dismounting of a used support 3B. The protective casing 9 serves as a sleeve allowing the handling of the refill 200.

In a variant embodiment not shown, the refill 200 comprises only the tool 8 and possibly the protective casing 9. In another embodiment not shown, the refill 200 comprises the tool 8 as well as the protective casing 9 carrying the cosmetic stick, without the support 3B.

Still referring to FIG. 11, the protective casing 9 comprises a tube 91 that has a first end segment 92 and a second end segment 93 opposite the first end segment 92. The first end segment 92 of the protective casing 9 is adjacent to the tool 8. The second end segment 93 of the protective casing 9 defines a free edge 93*a* of the protective casing 9, said edge 93*a* forming an opening 93*b* intended to receive the support 3B. The opening 93*b* of the protective casing 9 is visible in particular in FIG. 12. Thus, the support 3B and the tool 8 are positioned opposite each other on either side of the protective casing 9.

In particular, the first end segment 92 of the protective casing 9 is in the form of a truncated ogive 92. The ogive 92 comprises a bevelled flat face 92*a* and a frustoconical face 92*b*. The bevelled flat face 92*a* and the frustoconical face 92*b* define an edge 92*c* at which the tool 8 is attached to the protective casing 9.

It should be noted that the protective casing 9 is also connected to the tool 8 by means of a rib 94. The rib 94 is positioned between the bevelled flat face 92*a* of the protective casing 9 and the tool 8. Thus, the rib 94 reinforces the structure of the sub-assembly formed by the protective casing 9 and the tool 8. In the illustrated embodiment, the rib 94 is arranged at right angles between the bevelled flat face 92*a* and the tool 8.

With reference to FIG. 12, the opening 93*b* of the second end segment 93 of the protective casing 9 communicates with a chambering 95 intended to receive the support 3B, and more specifically the cap 62 of the support 3B, by elastic nesting. Elastic nesting means that the cap 62, which has a nominal diameter slightly larger than the diameter of the chambering 95, has this nominal diameter reduced by elastic deformation of the lips of the cap 62.

The chambering 95 of the protective casing 9 has a transverse bottom 95*a* and a lateral wall 95*b*. The lateral wall 95*b* extends perpendicularly from the bottom 95*a*. The transverse bottom 95*a* forms an internal shoulder of the tube 91. In addition, the chambering 95 is provided with at least a first distal coupling means 96 intended to cooperate with the first hooking means 67 of the barrel 6 of the support 3B in order to prevent a rotation of the support 3B with respect to the protective casing 9. The chambering 95 is also provided with at least one second distal coupling means 97 which cooperates with a second hooking means of the barrel 6 of the support 3B in order to prevent an axial withdrawal of the support 3B with respect to the protective casing 9.

Thus, the first distal coupling means 96 of the protective casing 9 and the first hooking means 67 of the support 3B of the refill 200 form anti-rotation means. The second distal coupling means 97 of the protective casing 9 and the second hooking means of the support 3B form axial anti-pull-out means.

In the embodiment shown in FIG. 12, the first distal coupling means 96 of the protective casing 9 is formed on the lateral wall 95*b* of the chambering 95. The first distal coupling means 96 comprises at least one vertical rib 96 that extends radially from the lateral wall 95*b* of the chambering 95. In particular, as best illustrated in FIG. 13, the at least one vertical rib 96 has a first edge 96*a* connected to the bottom 95*a* of the chambering 95. The at least one vertical rib 96 also has a second free edge 96*b* opposite the first edge 96*a*. The second edge 96*b* of the at least one rib 96 is located at a distance from the free edge 93*a* of the protective casing 9. Here, the first distal coupling means 96 comprises two vertical ribs 96 that are diametrically opposed.

Furthermore, as illustrated in FIGS. 6 and 7, the first hooking means 67 of the support 3B comprises at least one vertical slit 67 that extends from a free edge 62*a* of the barrel 6 of the support 3B. Here, the first hooking means 67 of the support 3B comprises two slits 67*a*, 67*b* that are also diametrically opposed. The slits 67*a*, 67*b* are intended to cooperate with the ribs 96.

Also according to the embodiment shown in FIG. 12, the second distal coupling means 97 is formed on the lateral wall 95*b* of the chambering 95. The second distal coupling means 97 comprises at least one circumferential rib 97 that extends at least partly around a circumference of the lateral wall 95*b* of the chambering 95. As best illustrated in FIG. 13, the at least one circumferential rib 97 comprises two inclined faces 97*a*, 97*b* that form an obtuse angle with each other. Here, the second coupling means 97 comprises two circumferential ribs 97 that each extend between the vertical ribs 96. Furthermore, according to the embodiment illustrated in FIG. 7, the second hooking means 66*c* of the shaft 6 for the support 3B comprises the first straight segments 66*a* and the first ramps 66*b* of the barrel 6. The first straight segments 66*a* and the second ramps 66*b* of the barrel 6 are intended to cooperate with the circumferential ribs 97.

Thus, when the barrel 6 of the support 3B is mounted in the chambering 95, the first straight segments 66*a* of the barrel 6 are elastically nested under the circumferential ribs 97. At the same time, the first ramps 66*b* of the barrel 6 of the support 3B are positioned opposite the inclined faces 97*b* of the circumferential ribs 97. Furthermore, the free edge 62*a* of the barrel 6 of the support 3B is in axial abutment against the bottom 95*a* of the chambering 95 (see FIG. 14). Finally, as shown in FIG. 11, the vertical ribs 96 of the protective casing 9 are engaged in the slits 67 of the barrel 6 of the support 3B. The circumferential ribs 97 thus prevent the support 3B from being pulled-out from the protective casing 9. On their side, the vertical ribs 96 prevent the rotation of the support 3B with respect to the protective casing 9 of the refill 200.

Referring again to FIG. 11, the protective casing 9 of the refill 200, and more specifically the tube 91 of the protective casing 9, comprises a housing 98 that communicates with the housing 64 of the barrel 6 of the support 3B. The two housings 64, 98 form a volume V intended to receive a molten material which, after solidification, forms the cosmetic stick P. The volume V thus has an internal shape and internal dimensions which correspond to an external shape and external dimensions of the cosmetic stick P. In particular, the volume V is delimited by a slope which is intended to confer on the cosmetic stick a bevelled shape. The slope of the volume V corresponds to an internal face of the bevelled wall 92*a* of the ogive 92.

It should be noted that the molten material is casted into the volume V through the opening 63*g* of the barrel 6 of the support 3B (see FIG. 7). Furthermore, after the casting operation, the opening 63*g* of the barrel 6 of the support 3B is closed by the plug 7 visible in FIG. 11.

Referring again to FIG. 12, the tool 8 of the refill 200 comprises a transverse bottom 81 as well as a lateral wall 82 that extends perpendicularly from the bottom 81. In particular, the bottom 81 of the tool 8 has an external face 81*b* that faces the bevelled face 92*a* of the protective casing 9. Furthermore, the bottom 81*b* of the tool 8 is connected to the protective casing 9 on the one hand by the rib 94 and on the other hand by the straight edge 92*c* of the protective casing 9. Furthermore, the lateral wall 82 of the tool 8 defines a free edge 82*b* and an opening 82*c*.

It should be noted that the bottom 81 and the lateral wall 82 of the tool 8 form a housing 83. More specifically, the housing 83 of the tool 8 is formed by an internal face 81*a* of the bottom 81 and an internal face 82*a* of the lateral wall 82 of the tool 8. The housing 83 of the tool 8 communicates with the opening 82*c*.

Thus, the tool 8 is configured to be received around the barrel 6 of the support 3B mounted in a receptacle 100. More specifically, the tool 8 is configured to be received around the cap 62 of the barrel 6 of the support 3B mounted in a receptacle 100.

To facilitate mounting the tool 8 around the cap 62 of the support 3B mounted in the receptacle 100, the tool 8 has a chamfer 82*d* at the level of the opening 82*c*. In particular, the chamfer 82*d* is formed between the internal face 82*a* of the lateral wall 82 and the free edge 82*b* of the tool 8.

Furthermore, in order to allow a coupling with the used support 3B, the tool 8 has a first proximal coupling means 84 intended to cooperate with the first hooking means 67 of the barrel 6 for the used support 3B. The tool 8 also has a second proximal coupling means 82*c* intended to cooperate with a second hooking means of the barrel 6 for the used support 3B.

In the illustrated embodiment, the first proximal coupling means 84 of the tool 8 comprises at least one vertical rib 84 that extends radially from the internal face 82*a* of the lateral wall 82 of the tool 8. The at least one rib 84 has a first edge 84*a* connected to a shoulder 85 of the housing 83. In addition, the at least one rib 84 has a free edge 84*b* located at a distance from the free edge 82*b* of the tool 8. Here, the first coupling means 84 of the tool 8 comprises two vertical ribs 84 that are diametrically opposed. The first hooking means 67 of the barrel 6 of the used support 3B comprises two vertical slits 67. The vertical ribs 84 are thus configured to engage the slits 67 in the barrel 6 of the used support 3B.

Also according to the illustrated embodiment, the second proximal coupling means 82*c* of the tool 8 is formed by the internal face 82*c* of the lateral wall 82 of the tool 8. The second hooking means of the barrel 6 for the used support 3B comprises the lips of the cap 62. Thus, the lips of the cap 62 ensure that the barrel 6 of the used support 3B nests elastically into the housing 83 of the tool 8. As a result of this elastic nesting, the first straight segments 66*a* of the external face of the cap 62 are in tight contact with the internal face 82*c* of the lateral wall 82 of the tool 8.

Elastic nesting means that the cap 62, which has a nominal diameter slightly larger than the diameter of the housing 83 of the tool 8, has this nominal diameter reduced by elastic deformation of the lips of the cap 62.

With reference to FIG. 15, the steps for using the refill 200 in its complete configuration as shown in FIG. 11 are now described. During these steps, the protective casing 9 of the refill 200 serves as a sleeve.

First, the user positions the tool 8 opposite the open receptacle 100, i.e. without the cover 4 of the receptacle 100 (see step 1). The cup is in the upper position of use. Then, thanks to the chamfer 82*d* formed at the level of the opening 82*c* of the tool 8, the user can nest it around the cap 62 of the barrel 6 of the used support 3B. At the end of this step, the ribs 84*a*, 84*b* of the tool 8 are engaged in the slits 67 of the barrel 6 of the used support 3B. The internal shoulder 85 of the tool 8 abuts against the free edge 62*a* of the barrel 6 of the used support 3B.

Secondly, by a rotational movement of the refill 200, the user unscrews the used support 3B (step 2), before removing it from the receptacle 100 (step 3).

Thirdly, the user turns the refill 200 over in order to position the substitution support 3B' opposite the receptacle 100 (step 4). In parallel, the user can detach the used support 3B from the tool 8 (step 5), before screwing the substitution support 3B' onto the irremovable portion 3A of a cup 3 that remains in place in the receptacle 100 (step 6).

Finally, when the substitution support 3B' is solidly attached to the receptacle, the user pulls on the sub-assembly formed by the protective casing 9 and the tool 8, which allows this sub-assembly to be disengaged from the substitution support 3B' and the cosmetic stick P to be demoulded (step 7). During the ascendant movement of the sub-assembly formed by the protective casing 9 and the tool 8, the inclined faces 97*b* of the circumferential ribs 97 slide along the ramps 66*b* of the barrel 6 of the support 3B. This allows the straight segments 66*a* of the barrel 6 to be disengaged from the locking position between the inclined faces 97*b* and the transverse bottom 95*a* of the chambering 95.

In the example of use shown in FIG. 15, the substitution support 3B' carries a large cosmetic stick P. This stick replaces a small stick that the used support 3B carried. We can note the presence of an elevator 71 on the barrel 6 of the used support 3B.

The invention claimed is:

1. A module of a cup for a mechanism of a cosmetic stick, the module being configured to receive a cosmetic stick, to form a removable portion of the cup and to be nested inside an irremovable portion of the cup, the module comprising at least one mounting means adapted to be coupled to the irremovable portion of the cup, and a lower neck having:

a lower transverse bottom provided with a through opening; and an internal face provided with a first attachment means intended to cooperate with a second attachment means of an intermediate part configured to be attached at the level of the lower neck of the module.

2. A cup for a mechanism of a cosmetic stick, comprising an irremovable portion provided with at least one means of assembly with the mechanism, and a removable portion configured to receive a cosmetic stick and provided with at least one mounting means coupled to the irremovable portion for mounting the removable portion, the removable portion being nested inside the irremovable portion and comprising a lower neck having:

a lower transverse bottom provided with a through opening; and an internal face provided with a first attachment means intended to cooperate with a second attachment means of an intermediate part configured to be attached at the level of the lower neck of the removable portion.

3. The cup according to claim 2, wherein the first attachment means is a circular notch formed on the internal face of the removable portion, the second attachment means comprising at least one protrusion formed on an external face of a skirt of the intermediate part.

4. The cup according to claim 3, wherein the irremovable portion comprises at least one mounting means for mounting the irremovable portion, wherein the at least one mounting means for mounting the irremovable portion cooperates with the at least one means for mounting the removable portion, wherein the at least one mounting means for mounting the irremovable portion comprises an internal thread formed on an internal face of the irremovable portion, and wherein the at least one mounting means for mounting the removable portion comprises a thread formed on an external face of the removable portion.

5. A refill for a mechanism of a cosmetic stick, comprising a cosmetic stick and a support carrying the cosmetic stick, the support being configured to form a removable portion of a cup of the mechanism, the support comprising a lower neck having:

a lower transverse bottom provided with a through opening, an internal face provided with a first attachment means intended to cooperate with a second attachment means of an intermediate part configured to be attached at the level of the lower neck of the support.

6. The refill according to claim 5, wherein the support comprises at least one mounting means configured to reversibly cooperate with at least one means for mounting an irremovable portion of the cup of the mechanism.

7. The refill according to claim 6, further comprising a protective casing forming a housing intended to be in communication with a housing of the support, the housing of the protective casing and the housing of the support forming a volume of the cosmetic stick.

8. The refill according to claim 7, further comprising a tool configured to allow a dismounting of the support mounted in the cosmetic stick mechanism.

9. The refill according to claim 8, wherein the tool comprises at least one proximal coupling means configured to cooperate with at least one hooking means of the support mounted in the mechanism.

10. The refill according to claim 9, wherein the protective casing has a distal segment provided with at least one distal coupling means cooperating with the at least one hooking means of the support so that the support is attached to the protective casing.

11. The refill according to claim 10, wherein the distal segment of the protective casing is provided with at least one second distal coupling means cooperating with at least one second hooking means of the support.

12. The refill according to claim 11, wherein the tool is located at a proximal end of the protective casing, opposite the support.

13. The refill according to claim 5, wherein the intermediate part of the support is an elevator intended to hold the support in an upper position relative to a bottom of the mechanism.

14. The refill according to claim 5, wherein the intermediate part of the support is a sealing plug.

15. A receptacle for cosmetic product comprising a cup according to claim 4.

16. A receptacle for a cosmetic product comprising a refill according to claim 5.

* * * * *